United States Patent [19]

Fryda et al.

[11] Patent Number: 4,708,453

[45] Date of Patent: Nov. 24, 1987

[54] ARRANGEMENT FOR WET PROCESSING PHOTOSENSITIVE MATERIALS

[75] Inventors: Georg Fryda; Wilfried Hehn, both of Munich, Fed. Rep. of Germany

[73] Assignee: Agfa-Gevaert Aktiengesellschaft, Leverkusen, Fed. Rep. of Germany

[21] Appl. No.: 913,950

[22] Filed: Oct. 1, 1986

[30] Foreign Application Priority Data

Oct. 16, 1985 [DE] Fed. Rep. of Germany ..... 3536862

[51] Int. Cl.[4] ..... G03D 3/08

[52] U.S. Cl. ..... 354/320; 354/331; 220/4 R; 220/83; 226/189

[58] Field of Search ..... 354/316, 320, 321, 322, 354/331, 337, 338; 220/4 R, 66, 83; 226/189

[56] References Cited

U.S. PATENT DOCUMENTS 3,523,498 8/1970 Phleps ..... 354/321
4,353,635 10/1982 Tanaka ..... 354/320
4,439,033 3/1984 Freeman ..... 354/316

FOREIGN PATENT DOCUMENTS

WO85/02919 7/1985 PCT Int'l Appl. ..... 354/337

*Primary Examiner*—A. A. Mathews
*Attorney, Agent, or Firm*—Peter K. Kontler

[57] ABSTRACT

An arrangement for the wet processing of photographic materials includes a container for a processing bath. A rack for transporting the materials through the bath is removably mountable in the container. The container has a longitudinally extending bottom wall as well as a pair of longitudinally extending side walls, and these walls are constituted by a one piece extrusion consisting of a synthetic resin. The extrusion is shaped to match the outline of the rack. The container further has a pair of injection molded end walls which likewise consist of a synthetic resin. The end walls are fused to the respective ends of the extrusion. The rack is divided into two sections to facilitate introduction of the rack into, and removal of the rack from, the container.

33 Claims, 4 Drawing Figures

ARRANGEMENT FOR WET PROCESSING PHOTOSENSITIVE MATERIALS

BACKGROUND OF THE INVENTION

The invention relates generally to the wet processing of photosensitive articles, e.g., photographic materials.

More particularly, the invention relates to an arrangement for wet processing photosensitive articles.

A known arrangement for wet processing photosensitive articles includes a container for accommodating a processing bath, and a rack mountable in the container to advance the articles through the bath. The rack comprises a pair of spaced plates carrying a series of cooperating transporting rollers.

Commercially available processing containers or tanks employed in arrangements of this type are produced by means of injection molding or deep drawing, or by adhesively joining and fusing preformed plates to one another. The injection molding and deep drawing processes have the drawback that different implements are required for different containers. Moreover, all of the conventional production processes have the drawback that it is not possible to match the configuration of the container to that of the rack so as to minimize the volume of processing fluid.

OBJECTS AND SUMMARY OF THE INVENTION

It is an object of the invention to provide a relatively inexpensive wet processing arrangement for photosensitive articles.

Another object of the invention is to provide a wet processing container which may be produced relatively economically.

An additional object of the invention is to provide a wet processing container which may be produced in a variety of lengths employing common implements.

A further object of the invention is to provide a wet processing container which may be shaped to the configuration of the transporting means to be mounted inside the container for advancing photosensitive articles therethrough.

It is also an object of the invention to provide a method which allows a wet processing container to be produced in a variety of lengths relatively inexpensively.

Yet another object of the invention is to provide a method which enables a wet processing container to be shaped to the configuration of the transporting means to be mounted inside the container for advancing photosensitive articles therethrough.

The preceding objects, as well as others which will become apparent as the description proceeds, are achieved by the invention.

One aspect of the invention resides in an arrangement for wet processing photosensitive articles, e.g., photographic materials. The arrangement comprises a container for accommodating a processing bath, and transporting means mountable in the container to advance photosensitive articles through the latter in a first direction transverse to a second direction across the widths of the articles. The transporting means may, for instance, be in the form of a rack having a pair of spaced plates which carry transporting rollers. The container includes wall means extending along the second direction, and the wall means comprises at least one first wall constituted by an extrusion. Preferably, the wall means comprises a one piece extrusion defining a plurality of first walls of the container. The container further includes second walls extending transverse to the second direction and bonded to the wall means. The second walls are advantageously fused to the wall means.

The wall means or the extrusion defining the first walls may consist of a synthetic resin. The second walls, which are preferably injection molded, may likewise consist of a synthetic resin.

The container of the invention may be produced by cutting an extruded wall section, which is designed to form the first walls of the container, to a length based on the required length of the container, and then fusing the second walls to the ends of the cut wall section. By producing the container in this manner, it becomes unnecessary to use different implements for containers of different length.

The production of the first walls using an extrusion process allows the first walls to be shaped to the configuration of the transporting means, e.g., a rack, to be placed inside the container. Less processing fluid is then required to fill the container thereby permitting savings in operating costs to be achieved. Furthermore, the use of an extrusion process makes it possible to form one or more receptacles on the first walls internally of the container. Such receptacles may, for example, be employed for cooling water so that there is no need to place special pipes in the container for cooling purposes.

The first walls, which extend across the widths of the photosensitive articles and may be considered to constitute longitudinal walls of the container, may be provided with inward and outward protuberances or bulges in order to conform to the shape of the transporting means. The protuberances may prevent the transporting means from being lowered into the container straight down and it may then be necessary to divide the transporting means into two or more separable sections which are inserted in the container sequentially one on top of the other. Such sections may be tilted from or inclined relative to the operative position during insertion so as to facilitate introduction thereof into the container. Sequential introduction of the sections into the container in such a manner that at least one of the sections is tilted from its operative position brings with it an advantage. Thus, when a rack is lowered into a processing bath straight down, air bubbles tend to be trapped in undercuts or recesses of the rack. By tilting one or more sections of the transporting means during immersion in the processing bath, air bubbles which may be present have the opportunity to escape.

The novel features which are considered as characteristic of the invention are set forth in particular in the appended claims. The improved wet processing arrangement itself, however, both as to its construction and its mode of operation, will be best understood from a perusal of the following detailed description of certain specific embodiments when read in conjunction with the accompanying drawings.

DESCRIPTION OF THE PREFERRED EMBODIMENTS

Figure 1:
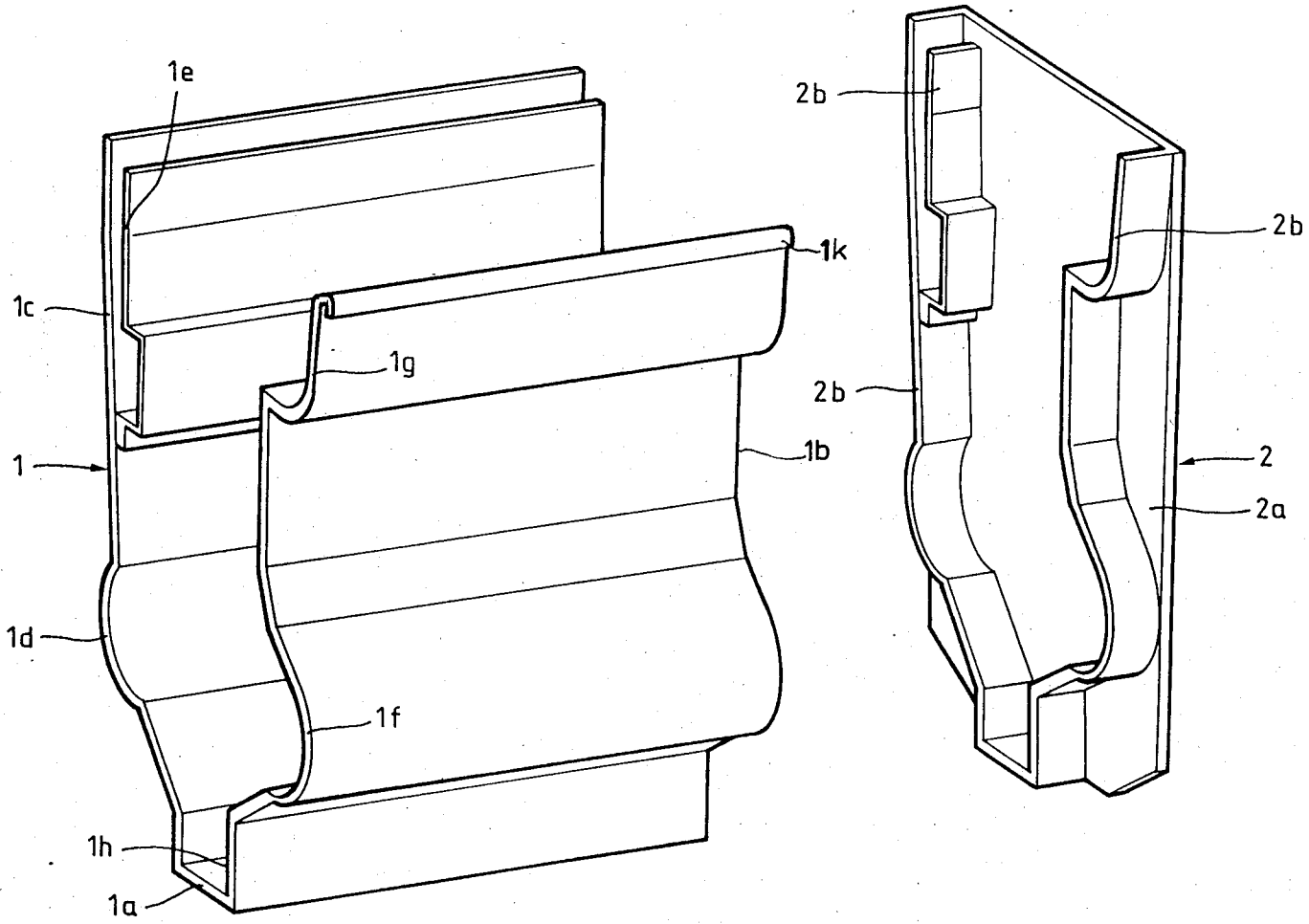
FIG. 1 is an exploded perspective view of one embodiment of a wet processing container according to the invention.
Figure 2:
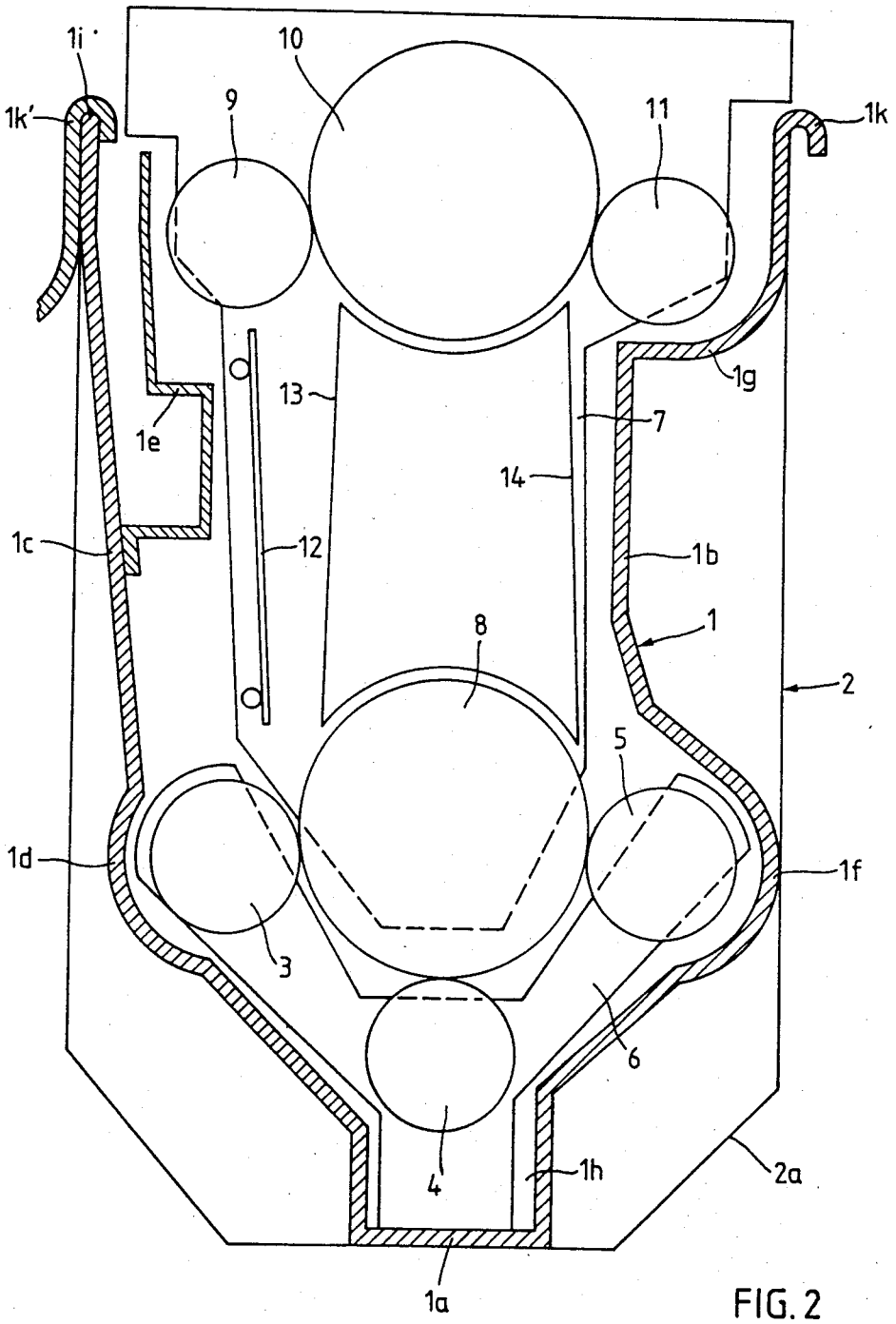
FIG. 2 is a sectional view of the container of FIG. 1 showing a rack inside the container.

FIGS. 1 and 2 show one embodiment of an arrangement for wet processing photosensitive articles such as, for instance, photographic materials. The wet processing arrangement includes a container or tank for accommodating a processing bath, and the container comprises a one piece extrusion 1 defining a bottom wall 1*a* and two side walls 1*b*,1*c* of the container. The bottom wall 1*a* and side walls 1*b*,1*c* constitute longitudinal walls of the container and extend across the widths of the articles which are conveyed through the processing bath in the container. The extrusion 1 consists essentially of a synthetic resin.

The lower part of the side wall 1*c* is formed with an outward protuberance or bulge 1*d* which constitutes a segment of a cylinder and defines a part-cylindrical recess inside the container. A dividing wall 1*e* is mounted on or is of one piece with the inner surface of the side wall 1*c* and is disposed in the upper part of such side wall. The dividing wall 1*e* extends longitudinally of the container and cooperates with the side wall 1*c* to define a receptacle running the length of the container internally of the latter. The receptacle may, for example, serve for the circulation of cooling water. The lower portion of the dividing wall 1*e* forms a protuberance or bulge projecting into the interior of the container. The dividing wall 1*e* further defines a recess above the protuberance.

The lower part of the side wall 1*b* is formed with an outward protuberance or bulge 1*f* while the upper part of this side wall is formed with an outward protuberance or bulge 1*g*. The protuberances 1*f*,1*g* define respective recesses inside the container. Each of these protuberances may constitute a segment of a cylinder, and the corresponding recesses are then part-cylindrical. The part of the side wall 1*b* between the protuberances 1*f*,1*g* includes a straight lower section which extends upward and inward from the protuberance 1*f*, and a straight upper section extending generally vertically from the lower section to the protuberance 1*g*.

The bottom wall 1*a* of the container cooperates with the lowermost portions of the side walls 1*b*,1*c* to define a trough or recess 1*h* at the bottom of the container.

To produce the wall means 1*a*,1*b*,1*c* of the container, synthetic plastic material is extruded and shaped to form the extrusion 1. The extrusion 1 is then cut to a length based on the required length of the container which, in turn, depends upon the widths of the photosensitive articles to be processed in the container. In this manner, the same implement or implements may be used to produce containers of greatly different length.

The container further comprises a pair of mirror symmetrical end walls 2 of which only one is shown in the drawings. The end walls 2 consist essentially of a synthetic resin and are constituted by injection moldings. Thus, the end walls 2 are produced by injection molding synthetic plastic material.

The illustrated end wall 2 includes a flat plate 2*a* which serves to support the container and to close the ends thereof. In order to increase the stability of the container, the plate 2*a* is made sufficiently wide to overlap the respective end face of the extrusion 1. The surface of the plate 2*a* which confronts the respective end face of the extrusion 1 is provided with a rib 2*b* which is here of one piece with the plate 2*a* and has an outline matching that of the extrusion 1. Accordingly, the rib 2*b* may be abutted with this end face in such a manner as to be in register therewith. Once the rib 2*b* has been positioned in this fashion, the rib 2*b* and the adjacent end face of the extrusion 1 are bonded to one another using a conventional joining process. Preferably, the rib 2*b* and the end face of the extrusion 1 are fused to each other.

In addition to the container 1,2, the wet processing arrangement of FIGS. 1 and 2 includes means for transporting photosensitive articles, e.g., film, through the container 1,2. The transporting means is illustrated in FIG. 2.

The transporting means comprises a set of transporting rollers 3,4,5 which are removably mounted in the lower part of the container 1,2. The rollers 3,4,5, which are not directly driven by a motor, cooperate to define an upwardly open pocket. In the illustrated embodiment, the rollers 3,4,5 constitute part of a rack which is divided into two separable sections, namely, a lower section and an upper section. The rollers 3,4,5 belong to the lower rack section which further includes a pair of spaced plates 6 of which only one is shown. The plates 6 carry the rollers 3,4,5, and each of the plates 6 is provided with a leg which is received in the trough 1*h* and rests on the bottom wall 1*a* of the container 1,2.

It is possible to eliminate the plates 6 and to support the rollers 3,4,5 directly on the end walls 2 of the container 1,2. To this end, the surfaces of the plates 2*a* which confront the extrusion 1 may be provided with projections in the form of bearing blocks or elements at appropriate locations. The bearing blocks, which have been omitted from the drawings for the sake of clarity, may have upwardly open seats so that the shafts of the rollers 3,4,5 may be placed on the bearing blocks from above. The bearing blocks may again be of one piece with the plates 2*a*.

The rollers 3,4,5 are disposed in the container 1,2 in such a manner that the roller 3 is at least partially received in the recess defined by the protuberance 1*d*; the roller 5 is at least partially received in the recess defined by the protuberance 1*f*; and the roller 4 is at least partially received in the trough 1*h*.

The dividing wall 1*e* and the part of the side wall 1*b* between the protuberances 1*f*,1*g* together define a constriction inside the container 1,2. This constriction presents little hindrance to insertion of the rollers 3,4,5 in or removal of the latter from the container 1,2 when the rollers 3,4,5 are individually supported by respective pairs of bearing blocks on the end walls 2. However, the situation is different when the rollers 3,4,5 constitute part of the lower rack section including the plates 6. Thus, the constriction prevents the lower rack section 3–6 from being introduced into and removed from the container 1,2 while the lower rack section 3–6 is in the operative position of FIG. 2. In order to move the lower rack section 3–6 by the constriction, it is necessary to tilt or rotate the lower rack section 3–6 from the operative position. Such tilting is of advantage when immersing the lower rack section 3–6 in a processing bath accommodated by the container 1,2. Thus, by tilting the lower rack section 3–6 during introduction into the processing bath, air which tends to collect underneath the lower rack section 3–6 has a chance to escape.

The upper rack section of the transporting means comprises a pair of spaced plates 7 of which only one is shown in the drawings. The plates 7 carry a relatively large lower transporting roller 8 as well as a set of upper transporting rollers including two relatively small rollers 9,11 which are spaced about and cooperate with a relatively large central roller 10. The rollers 9,11 may be idler rollers whereas the rollers 8,10 are driven by conventional drive means which have been omitted from the drawings for the sake of clarity. The roller 9 is partially received in the recess defined by the dividing wall 1*e*, and the roller 11 is partially received in the recess of the protuberance 1*g*.

The upper rack section is designed to be placed on the rollers 3,4,5 in such a manner that the lower transporting roller 8 is received in the pocket defined by and engages the rollers 3,4,5. The upper rack section is placed on the rollers 3,4,5 after the latter have been mounted in the container 1,2.

If the rollers 3,4,5 are supported by bearing blocks on the end walls 2, mounting of the transporting means in the container 1,2 is accomplished by first placing the rollers 3,4,5 on the respective pairs of bearing blocks. Once the rollers 3,4,5 are in position on the bearing blocks, the upper rack section is lowered into the container 1,2 so that the roller 8 is received in the pocket defined by the rollers 3,4,5. The upper rack section is designed such that it may be introduced into the container 1,2 while oriented in the operative position of FIG. 2. The upper rack section is here supported in the container 1,2 via non-illustrated projections in the form of bearing blocks or elements which are provided on, and may again be of one piece with, the plates 2*a* of the end walls 2. It is possible for the upper rack section to be supported by the same bearing blocks which support the rollers 3,4,5.

If the rollers 3,4,5 constitute part of the lower rack section including the plates 6, the transporting means is mounted in the container 1,2 by first introducing the lower rack section 3–6 into the container. After the lower rack section has been properly positioned inside the container 1,2, the upper rack section is lowered onto the lower rack section 3–6 so that the roller 8 is received in the pocket defined by the rollers 3,4,5. When the upper rack section is properly positioned in the container 1,2, the plates 7 of the upper rack section rest on the respective plates 6 of the lower rack section 3–6.

The rollers 9,10,11 function as an admitting and discharging means. Thus, the rollers 9,10,11 serve to draw photosensitive articles into, and to discharge the articles from, the container 1,2. The rollers 9,10,11 may be arranged on the lateral surfaces of the plates 7.

Each of the plates 7 of the upper rack section is provided with a pair of guides for the photosensitive articles. One of the guides on each plate 7 defines a guide surface 12 while the other guide defines two opposed guide surfaces 13,14. These guides may be of one piece with the respective plates 7 or may be mounted on the plates 7 in any other suitable fashion. A further guide surface for the photosensitive articles is defined between the rollers 5 and 11 by the inner surface of the part of the side wall 1*b* connecting the protuberances 1*f*,1*g*. This part of the side wall 1*b* may be considered to form an inward protuberance or bulge in the container 1,2.

Assuming that a photosensitive article is drawn into the container 1,2 by the rollers 9,10, the photosensitive article is first advanced into the gap between the guide surfaces 12,13. Subsequently, the photosensitive article is successively conveyed through the nip defined by the roller pair 3,8, the nip defined by the roller pair 4,8, and the nip defined by the roller pair 5,8. The photosensitive article then travels through the gap between the guide surface 14 and the inner surface of the side wall 1*b* to be discharged from the container 1,2 by the roller pair 10,11. It will be understood that the movement of the photosensitive article could be reversed, i.e., the photosensitive article could be drawn into the container 1,2 by the roller pair 10,11 and discharged from the container via the roller pair 9,10.

In FIG. 2, the width of the photosensitive article is normal to the plane of the paper so that the photosensitive article is conveyed through the container 1,2 in a direction transverse to its width. The extrusion 1 defining the longitudinal walls 1*a*,1*b*,1*c* of the container extends across the width of the photosensitive article and thus transverse to the direction of advance of the latter.

FIG. 2 shows that the extrusion 1 has an outline which is matched to that of the transporting means 3–14.

With reference still to FIG. 2, the side wall 1*c* of the container 1,2 has a straight or flat upper edge 1*i*. The side wall 1*b*, on the other hand, has a hook-shaped upper edge 1*k*. As illustrated at 1*k'*, the hook-shaped upper edge 1*k* of the container 1,2 is designed to be placed over and receive the flat upper edge 1*i* of another, similar container. This allows two or more wet processing containers to be suspended from and thus connected with one another. It is then possible to place such containers in a collecting tank as a unit in order to collect any processing fluid which may overflow.

Figure 3:
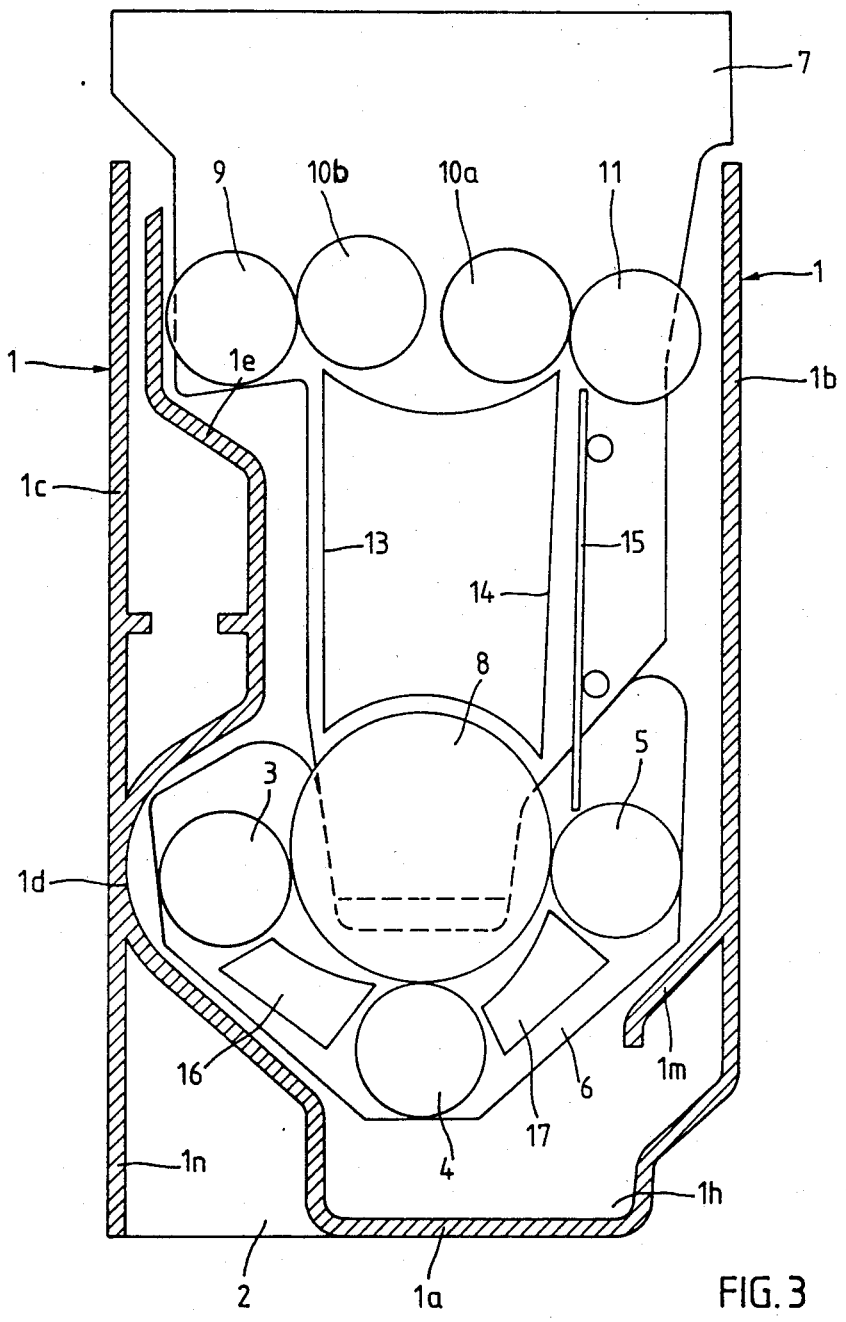
FIG. 3 is a sectional view of another embodiment of the container in accordance with the invention and shows a second embodiment of a rack inside the container.
Figure 4:
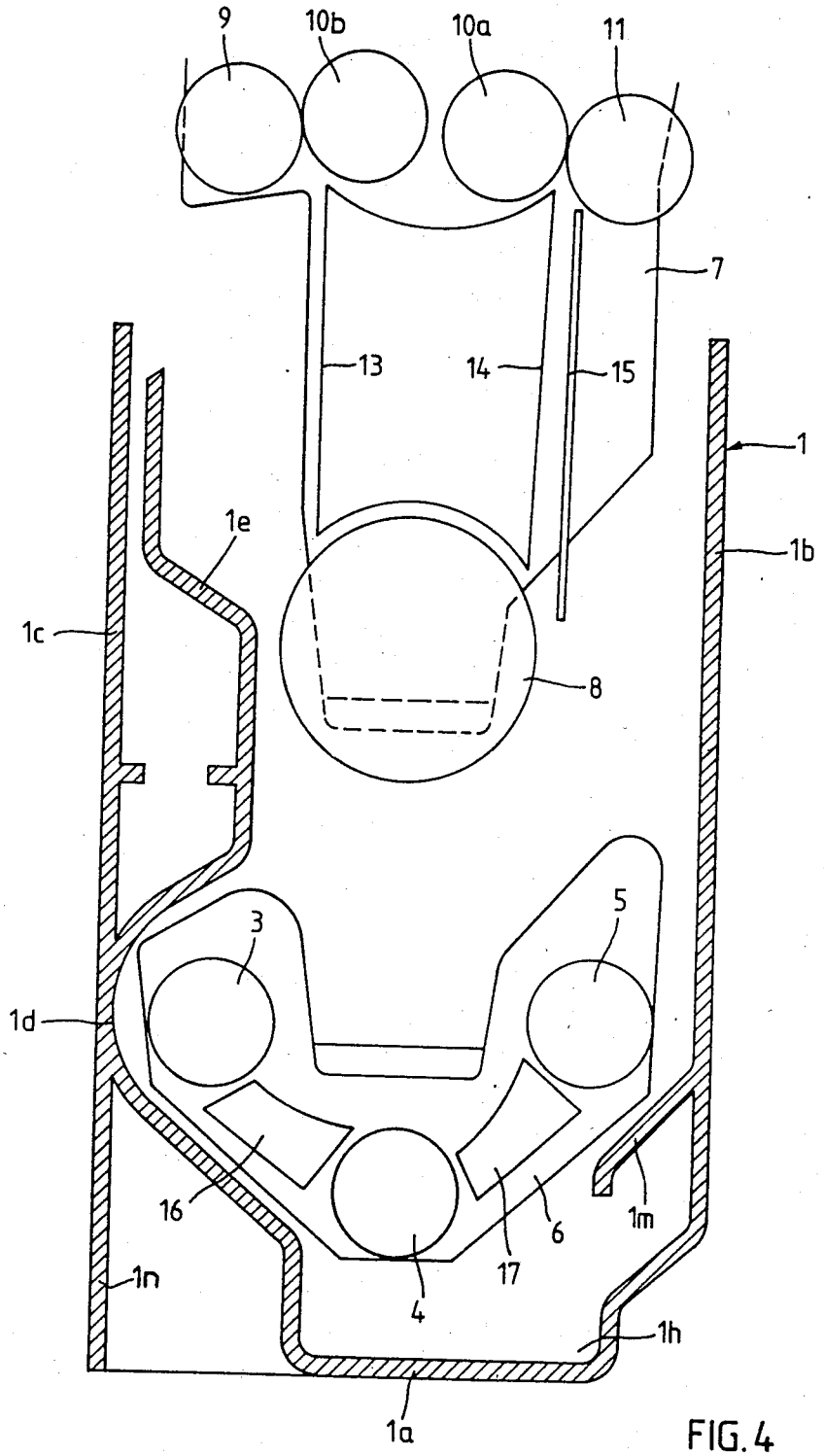
FIG. 4 illustrates the container and rack of FIG. 3 during insertion of the rack in the container.

FIGS. 3 and 4 illustrate a wet processing arrangement which again includes a container for a processing bath, and a rack removably mountable in the container. However, the container and rack of FIGS. 3 and 4 have somewhat different configurations than the container and rack of FIGS. 1 and 2. In FIGS. 3 and 4, those elements having a function similar to elements of FIGS. 1 and 2 are identified by the same reference numerals and are not again described in detail.

The container 1,2 of FIGS. 3 and 4 differs from the container of FIGS. 1 and 2 in several respects. To begin with, the bottom wall 1*a* is wider than that in FIGS. 1 and 2. Furthermore, the side wall 1*c* of the container 1,2 of FIGS. 3 and 4 has an extension 1*n* which projects from the protuberance 1*d* downwards to the lower end of the container. The extension 1*n*, which may be of one piece with the extrusion 1, is generally perpendicular to the horizontal when the container 1,2 is in the operative position of FIGS. 3 and 4. The extension 1*n* constitutes a projecting leg or additional support which enhances the stability of the container 1,2 in its operative position.

The wet processing arrangement of FIGS. 3 and 4 further differs from that of FIGS. 1 and 2 in that the dividing wall 1*e* is longer and extends downwards for a greater distance. Moreover, the protuberance defined by the dividing wall 1*e* in FIGS. 3 and 4 is longer than the protuberance defined by the dividing wall 1*e* in FIGS. 1 and 2. In FIGS. 3 and 4, the surface of such protuberance which faces the interior of the container 1,2 serves as a guide surface for the photosensitive articles so that the guide surfaces 12 of FIG. 2 may be eliminated.

The outward protuberances 1*f*,1*g* of FIGS. 1 and 2, as well as the inward protuberance defined by the side wall 1*b* between the protuberances 1*f*,1*g*, are omitted in FIGS. 3 and 4. The inward protuberance, which constitutes a guide for the photosensitive articles in FIGS. 1 and 2, is replaced in FIGS. 3 and 4 by a pair of guides each having a guide surface 15. These guides, of which only one is shown, may be of one piece with the respective plates 7 of the upper rack section or may be mounted on the plates 7 in any other suitable fashion. As illustrated in FIG. 3, the guides are disposed between the rollers 5 and 11 in the operative position of the rack constituting the transporting means for the photosensitive articles.

The hook-shaped upper edge 1*k* of the side wall 1*b* in FIG. 2 is likewise omitted in FIGS. 3 and 4.

At the location of the protuberance 1*f* of FIGS. 1 and 2, the side wall 1*b* of FIGS. 3 and 4 is provided with a downwardly inclined ledge 1*m*. The ledge 1*m*, which may be of one piece with the side wall 1*b*, is mounted on the inner surface of the latter and projects into the interior of the container 1,2. This ledge may serve as a support for the lower rack section. In FIGS. 3 and 4, the lower rack section rests on the ledge 1*m* and on the downwardly inclined part of the side wall 1*c* bounding the protuberance 1*d* from below. The leg which is provided on the lower rack section 3–6 of FIG. 2 and extends into the trough 1*h* is dispensed with in FIGS. 3 and 4.

The lower rack section of FIGS. 3 and 4 further differs from that of FIG. 2 in that a guide 16 for the photosensitive articles is disposed between the rollers 3 and 4 while another guide 17 is disposed between the rollers 4 and 5.

The wet processing arrangement of FIGS. 3 and 4 additionally differs from that of FIGS. 1 and 2 in that the relatively large central roller 10 of the upper rack section 7–14 is replaced by two smaller rollers 10*a*,10*b*. The roller 10*b* cooperates with the roller 9 whereas the roller 10*a* cooperates with the roller 11. FIG. 4 shows the upper rack section 7–11,13–15 during insertion in the container 1,2.

The extrusion 1 may assume configurations other than those illustrated depending upon the required path length for, or dwell time of, the photosensitive articles in the processing bath. Thus, if a larger number of transporting rollers must be employed, the side walls 1*b*,1*c* of the container 1,2 may be provided with a larger number of protuberances. Moreover, under appropriate circumstances, the rack may be divided into more than two sections. Furthermore, the inner surface of the side wall 1*b* may be provided with a dividing wall similar to the dividing wall 1*e* in order to form an additional receptacle inside the container 1,2. This may be desirable, for example, if both longitudinal walls 1*b*,1*c* are to be cooled by means of a cooling fluid. The dividing wall on the side wall 1*b* may be of one piece with the latter.

A common feature of all embodiments of the invention resides in that it is unnecessary to employ different implements in order to produce containers 1,2 of different length. Rather, it is merely necessary to cut the extrusion 1 to the required length. The various embodiments of the invention further have the common feature that the configuration of the container may be matched to that of the transporting means, i.e., may be matched to the configuration of the rack or to the roller distribution. This enables substantial savings of processing fluid to be achieved. In addition, the division of the transporting means or rack into two or more sections brings with it the advantage that, in the event of a disturbance, e.g., an undesired paper accumulation, the transporting means may be taken apart or removed section-by-section until the location of the disturbance is reached. This allows elimination of the disturbance to be facilitated.

Without further analysis, the foregonig will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An arrangement for wet processing photosensitive articles, comprising a container for accommodating a processing bath; and transporting means mountable in said container to advance photosensitive articles through the latter in a first direction transverse to a second direction across the widths of the articles, said container including wall means extending along said second direction, and said wall means comprising at least one first wall constituted by an extrusion, said container further including second walls extending transverse to said second direction and bonded to said wall means.

2. The arrangement of claim 1, wherein said wall means comprises a plurality of first walls constituted by a one piece extrusion.

3. The arrangement of claim 2, wherein said extrusion consists essentially of a synthetic resin.

4. The arrangement of claim 1, wherein said second walls are injection molded.

5. The arrangement of claim 4, wherein each of said second walls consists essentially of a synthetic resin.

6. The arrangement of claim 1, wherein said second walls are fused to said wall means.

7. The arrangement of claim 1, wherein said transporting means comprises a rack having a transporting roller.

8. The arrangement of claim 1, wherein said wall means has an outline at least in part matched to that of said transporting means.

9. The arrangement of claim 8, said transporting means including at least one transporting roller arranged to be disposed at a predetermined location of said container; and wherein said wall means defines a recess in the region of said predetermined location designed to receive at least a portion of said roller.

10. The arrangement of claim 9, wherein said recess is part cylindrical.

11. The arrangement of claim 8, wherein said wall means defines a protuberance constituting a guide for the photosensitive articles.

12. The arrangement of claim 1, said container having a lower portion; and wherein said transporting means comprises separable first and second sections, said first section including a plurality of first transporting rollers mountable in said lower portion so as to define an upwardly open pocket, and said second section including a second transporting roller receivable in said pocket from above so as to engage said first rollers.

13. The arrangement of claim 12, wherein said second section comprises additional transporting rollers for drawing photosensitive articles into and discharging the same from said container when said second roller is disposed in said pocket.

14. The arrangement of claim 13, wherein each of said first and second sections constitutes a section of a rack.

15. The arrangement of claim 12, wherein said first section comprises three transporting rollers.

16. The arrangement of claim 12, wherein said second walls are provided with projections constituting supports for said first rollers.

17. The arrangement of claim 16, wherein said projections are of one piece with said second walls.

18. The arrangement of claim 12, said first section including a pair of spaced plates which carry said first rollers; and wherein said wall means defines a trough at the bottom of said container designed to receive portions of said plates.

19. The arrangement of claim 12, said second section including a pair of spaced plates which carry said second roller; and wherein said second walls are provided with projections constituting supports for said plates.

20. The arrangement of claim 19, wherein said projections are of one piece with said second walls.

21. The arrangement of claim 12, said first section including a first pair of spaced plates which carry said first rollers, and said second section including a second pair of spaced plates which carry said second roller; and wherein the plates of said second pair are designed to be seated on respective plates of said first pair.

22. The arrangement of claim 12, wherein said wall means is provided with an inclined ledge arranged to support one of said sections.

23. The arrangement of claim 22, wherein said one section is said first section.

24. The arrangement of claim 22, wherein said ledge is of one piece with said wall means.

25. The arrangement of claim 12, wherein at least one of said sections is provided with a guide for the photosensitive articles.

26. The arrangement of claim 1, comprising a receptacle on said wall means internally of said container.

27. The arrangement of claim 26, wherein said receptacle is defined by said wall means.

28. The arrangement of claim 1, said wall means having an outwardly directed protuberance defining a recess in said container arranged to receive a portion of said transporting means; and wherein said wall means comprises an extension projecting from said protuberance to the lower end, and constituting a leg, of said container.

29. The arrangement of claim 28, wherein said extension is at least approximately perpendicular to the horizontal when said extension supports said container.

30. The arrangement of claim 1, said wall means having opposite ends, and each of said ends being provided with an end face defining a predetermined outline; and wherein each of said second walls confronts one of said ends and includes a rib having the outline of the respective end face, said ribs being in register with and bonded to said end faces.

31. The arrangement of claim 30, wherein said second walls are of one piece.

32. The arrangement of claim 1, said wall means having a pair of upper edges; and wherein one of said edges is hook-shaped.

33. The arrangement of claim 32, wherein the other of said edges is essentially straight.

* * * * *